US005491868A

United States Patent [19]

Baggenstos

[11] Patent Number: 5,491,868

[45] Date of Patent: Feb. 20, 1996

[54] CONTAINER CLEANING SPATULA

[76] Inventor: Bruce Baggenstos, 1814-B Empire Industrial Ct., Santa Rosa, Calif. 95403

[21] Appl. No.: 494,715

[22] Filed: Jun. 26, 1995

[51] Int. Cl.[6] ..... A47L 13/08; A47L 17/06

[52] U.S. Cl. ..... 15/236.09; 15/236.01; 15/236.05; 15/236.06; 15/236.07; 30/169; D32/49

[58] Field of Search ..... 15/236.01, 236.05, 15/236.06, 236.07, 236.08, 236.09; 30/169, 172; D32/46, 48, 49; D7/688

[56] References Cited

U.S. PATENT DOCUMENTS

| | | | |
|---|---|---|---|
| D. 34,656 | 6/1901 | Selk | D32/49 |
| 1,437,199 | 11/1922 | Same | 30/169 |
| 1,473,143 | 11/1923 | Dean | 15/236.01 |
| 1,529,309 | 3/1925 | Hoegberg | 30/169 |
| 4,553,279 | 11/1985 | Gassew | 15/236.09 |
| 4,627,128 | 12/1986 | Shea | 15/236.07 |
| 4,628,563 | 12/1986 | Kramer | 15/236.05 |
| 4,987,635 | 1/1991 | Young | 15/236.01 |
| 5,065,977 | 11/1991 | Desjardin | 15/236.08 |

FOREIGN PATENT DOCUMENTS

| | | | |
|---|---|---|---|
| 0320130 | 10/1929 | United Kingdom | 15/236.05 |

*Primary Examiner*—David Scherbel
*Assistant Examiner*—Randall E. Chin

[57] ABSTRACT

A container cleaning spatula includes a generally rectangular scoop attached to an elongated handle. A pair of tabs extend rearwardly from a rearward edge of the scoop. The tabs have outside edges that are collinear with the straight side edges of the scoop, and are coplanar with the edge portions thereof. The spatula is used to remove residual viscous material from a container by scraping a straight side edge of the scoop against the wall of the container. The spatula is also used to remove residual material from under an inverted U-shaped rim of a typical container by engaging a tab thereunder, and running the tab therealong.

3 Claims, 1 Drawing Sheet

CONTAINER CLEANING SPATULA

BACKGROUND OF THE INVENTION

1. Field of the Invention

This invention relates generally to spatulas, specifically to a spatula for cleaning and salvaging residual material from the interior of a container.

2. Prior Art

When a container that holds a viscous material is substantially emptied, some residual material will still adhere to its wall and bottom. A typical metal container, such as a paint can, also has an overturned rim in the shape of an inverted "U" that traps residual material thereunder.

Various tools have been proposed for salvaging residual material from and cleaning a container. U.S. Pat. No. 4,627,128 to Shea (1986) shows a tool that includes a semi-cylindrical scoop attached to a handle. The scoop includes a semi-circular end wall at its rearward or handle end, and an olive-shaped end wall at the forward end. The longitudinal sides of the scoop are used to scrape residual material from the wall of a round container by engaging it thereon and running it around the wall. Alternatively, the olive-shaped end wall can be used to scrape residual material from the wall by pulling it along the axis of the container. However, the scoop cannot remove residual material from under the inverted U-shaped rim of metal cans.

U.S. Pat. No. 4,987,635 to Young (1991) shows a trowel that includes a flat, rectangular blade attached to a handle. An arc-shaped, flat end piece extends from the forward end of the blade at a predetermined angle from the plane of the blade. Two protrusions extend from the rearward end of the blade at a complementary or opposite angle from the plane of the blade. The arc-shaped end piece is used to scrape residual material from the wall of a round container by pulling it along the axis thereof. Each protrusion is used to scrape material from under the inverted U-shaped rim of the container by positioning and engaging the protrusion thereunder, and running it therealong. However, the longitudinal sides of the blade cannot be used to scrape material from the wall of the container, because the end piece and protrusions, which are set at opposite angles, prevent the sides of the blade from lying flat against the wall. Therefore, the trowel can only scrape material from the wall with its relatively narrow end piece, which is slow and inefficient.

Objects Of The Invention

Accordingly, a primary object of the present invention is to provide a container cleaning spatula that can be used to quickly salvage residual material from the wall a container with its longitudinal side edges.

Another object of the present invention is to provide a container cleaning spatula that can be used to salvage residual material from the bottom of the container with its forward edge.

Still another object of the present invention is to provide a container cleaning spatula that can be used to salvage residual material from under the inverted U-shaped rim of the container with a pair of tabs.

Other objects of the invention will become apparent from a study of the drawing figures and the following description.

Figure 1:
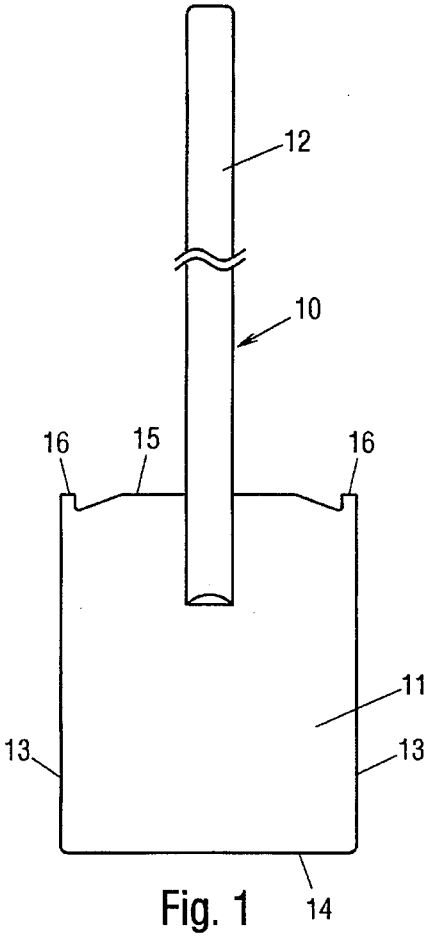
FIG. 1 is a side view of a container cleaning spatula in accordance with a preferred embodiment of the invention.

| Drawing Reference Numerals | |
|---|---|
| 10. Spatula | 11. Scoop |
| 12. Handle | 13. Straight Longitudinal Side Edges |
| 14. Forward Edge | 15. Rearward Edge |
| 16. Tabs | 17. Residual Material |
| 18. Wall Of Container | 19. Container |
| 20. Inverted U-Shaped Rim | 21. Bottom |

DESCRIPTION OF THE PREFERRED EMBODIMENT

Figure 2:
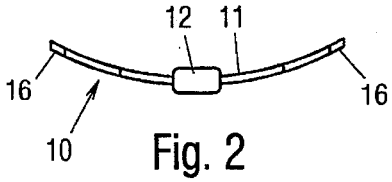
FIG. 2 is a top end view of the container cleaning spatula.

In accordance with a preferred embodiment of the invention shown in the side and top views of FIGS. 1 and 2, respectively, a container cleaning spatula 10 includes a substantially rectangular scoop 11 intetrally attached to the forward end of an elongated handle 12. Rectangular scoop 11 includes straight longitudinal side edges 13, a transverse forward edge 14, a transverse rearward edge 15, and a pair of integral rectangularly shaped tabs 16 extending rearwardly from rearward edge 15. Scoop 11 is longitudinally straight and transversely curved, i.e., it is in the shape of a cylindrical section. Tabs 16 are coplanar with the side edge portions of scoop 11, and the outside edge of each tab 16 is collinear with a corresponding side edge 13.

Figure 3:
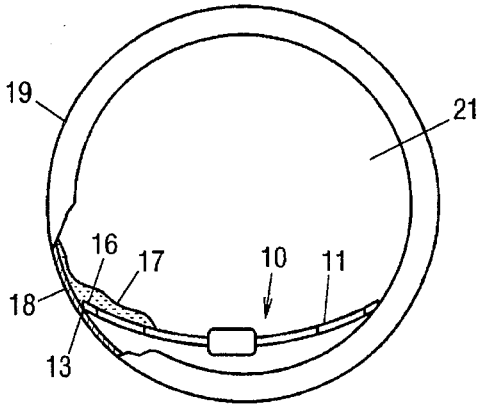
FIG. 3 is a top view of the container cleaning spatula cleaning a wall of a container.

As shown in the top view in FIG. 3, spatula 10 is used to remove residual viscous material 17 from a wall 18 of a typical cylindrical container 19, which is shown partially cutaway, by laterally scraping wall 18 with edge 13. Because tab 16 is coplanar with the side edge portion of scoop 11, the entire side edge 13 can lie flat against wall 18 to scrape material 17.

Figure 4:
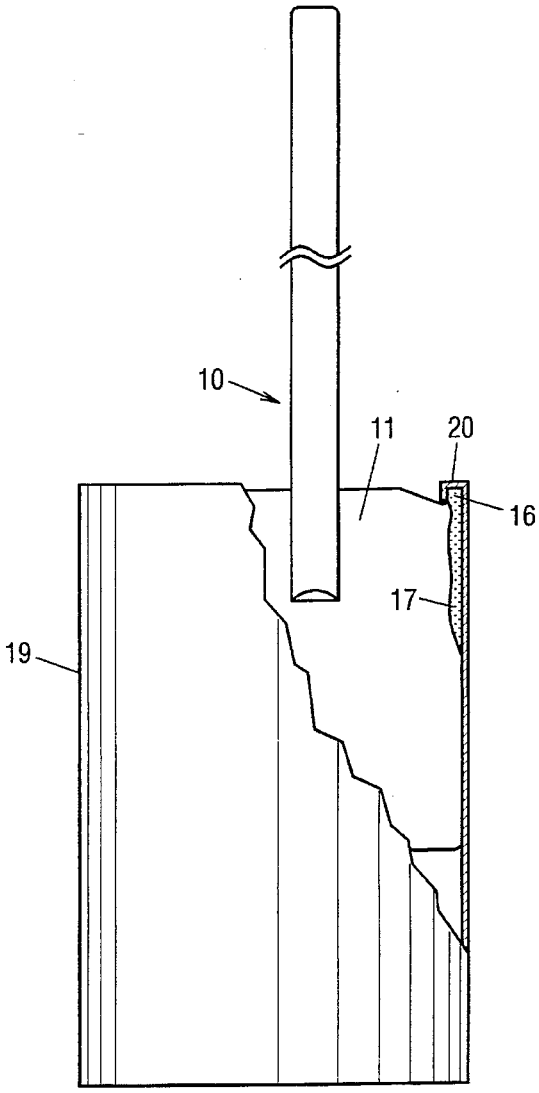
FIG. 4 is a side view of the container cleaning spatula cleaning the underside of a rim of the container.

As shown in the side view in FIG. 4, spatula 10 is used to scrape residual material 17 from under an inverted U-shaped rim 20 of container 19 by positioning tab 16 under and against the inside of rim 20, and running tab 16 therealong.

Spatula 10 can also be used to clean a bottom 21 of container 19 by scraping material 17 therefrom onto wall 18 with forward edge 14 (FIG. 1), and then scraping material 17 with side edge 13 in the manner shown in FIG. 3.

Conclusion, Ramifications, And Scope

Accordingly, the reader will see that I have provided a container cleaning spatula for thoroughly removing residual material from a container. It can remove residual material from the wall, the bottom, as well as under the overturned rim of a typical container.

Although the above descriptions are specific, they should not be considered as limitations on the scope of the invention, but only as examples of the preferred embodiment. Many other ramifications and variations are possible within the teachings of the invention. For example, the proportions of the scoop can be different for fitting different containers. The proportions of the tabs can be changed to fit different types of overturned rims. The spatula can also be used to clean and salvage residual material from rectangular containers. Therefore, the scope of the invention should not be determined by the examples given, but by the appended claims and their legal equivalents.

I claim:

1. A spatula for cleaning residual material from a container, comprising:

an elongated handle having a rearward end and a forward end, a generally rectangular scoop having a transverse rearward edge attached to said forward end of said handle, said scoop having a transverse forward edge, and a pair of straight longitudinal side edges, said scoop being longitudinally straight and transversely curved, and a pair of rectangularly shaped tabs extending rearwardly from said rearward edge, each of said tabs having an outside edge collinear with a respective one of said pair of straight longitudinal side edges, each of said tabs being coplanar with a respective one of said pair of straight longitudinal side edges of said scoop, whereby said side edges are usable for scraping said residual material from a wall of said container, and said tabs are usable for scraping said residual material from an inverted U-shaped rim of said container by positioning and engaging one of said tabs thereunder, and moving one of said tabs therealong.

2. The spatula of claim 1 wherein said handle is integrally attached to said scoop.

3. The spatula of claim 1 wherein said tabs are integrally attached to said scoop.

* * * * *